US005882742A

United States Patent [19]

Lin

[11] Patent Number: 5,882,742

[45] Date of Patent: Mar. 16, 1999

[54] DECORATION LAMP NETTING

[76] Inventor: Mei-Lu Lin, 56, Min Sheng Street, Fengyuan, Taichung, Taiwan

[21] Appl. No.: 877,632

[22] Filed: Jun. 20, 1997

[51] Int. Cl.[6] ..... F21V 33/00

[52] U.S. Cl. ..... 428/9; 428/7; 362/252; 362/806

[58] Field of Search ..... 428/7, 9; 362/252, 362/806, 808

[56] References Cited

U.S. PATENT DOCUMENTS 4,966,793 10/1990 Covell ..... 428/7

5,601,361 2/1997 Lawrence ..... 362/806

*Primary Examiner*—Alexander Thomas

[57] ABSTRACT

A decoration lamp netting has a net, a serial decoration lamp assembly disposed on the net, the serial decoration lamp assembly having a plurality of decoration lamps and an electric plug, a plurality of retainer members retaining the respective decoration lamps on the net, and two opposite rods disposed on two laterals of the net. The decoration lamp netting is disposed on a plate.

4 Claims, 6 Drawing Sheets

DECORATION LAMP NETTING

BACKGROUND OF THE INVENTION

This invention relates to a decoration lamp netting, and more particularly, this invention relates to a decoration lamp netting which contains a plurality of decoration lamps.

A conventional lamp netting for a Christmas tree has a serial decoration lamp assembly disposed on a fabric. However, the fabric has a plurality of holes to receive the respective clamps. Furthermore, the fabric will fall down under a strong wind while the fabric is placed outdoors.

SUMMARY OF THE INVENTION

An object of this invention is to provide a decoration lamp netting to position a serial decoration lamp assembly on a net so that the decoration lamp netting can be wound.

Another object of this invention is to provide a decoration lamp netting to position a serial decoration lamp assembly on a foldable net so that the decoration lamp netting will not fall down under a strong wind while the decoration lamp netting is placed outdoors.

DETAILED DESCRIPTION OF THE INVENTION

Figure 1:
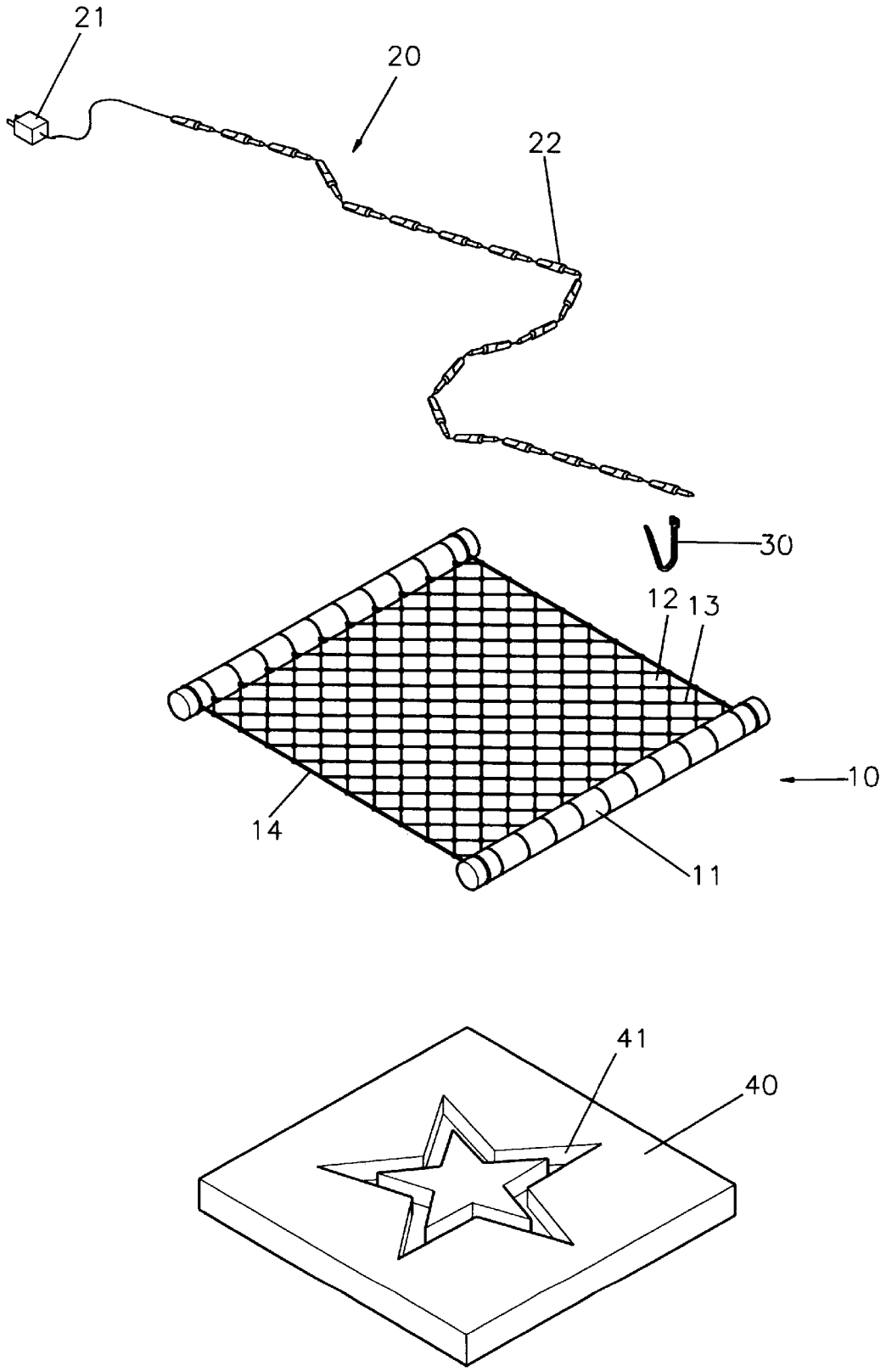
FIG. 1 is a perspective exploded view of a decoration lamp netting.
Figure 1A:
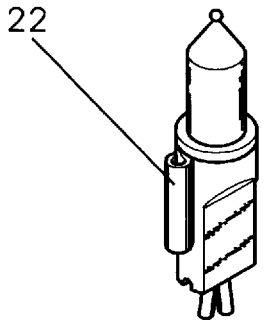
FIG. 1A is a perspective view of a decoration lamp.
Figure 2A:
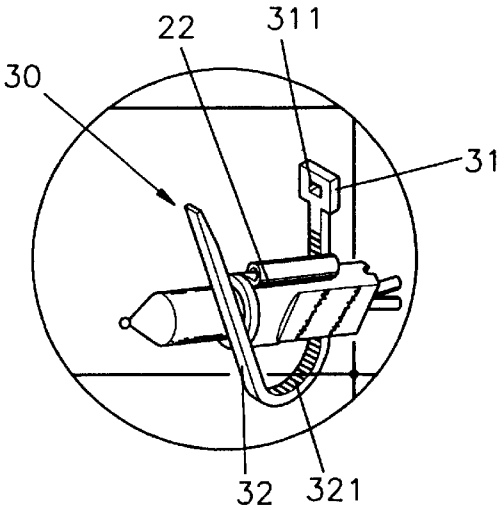
FIG. 2A is a perspective view illustrating a retainer member clamping a decoration lamp.
Figure 2:
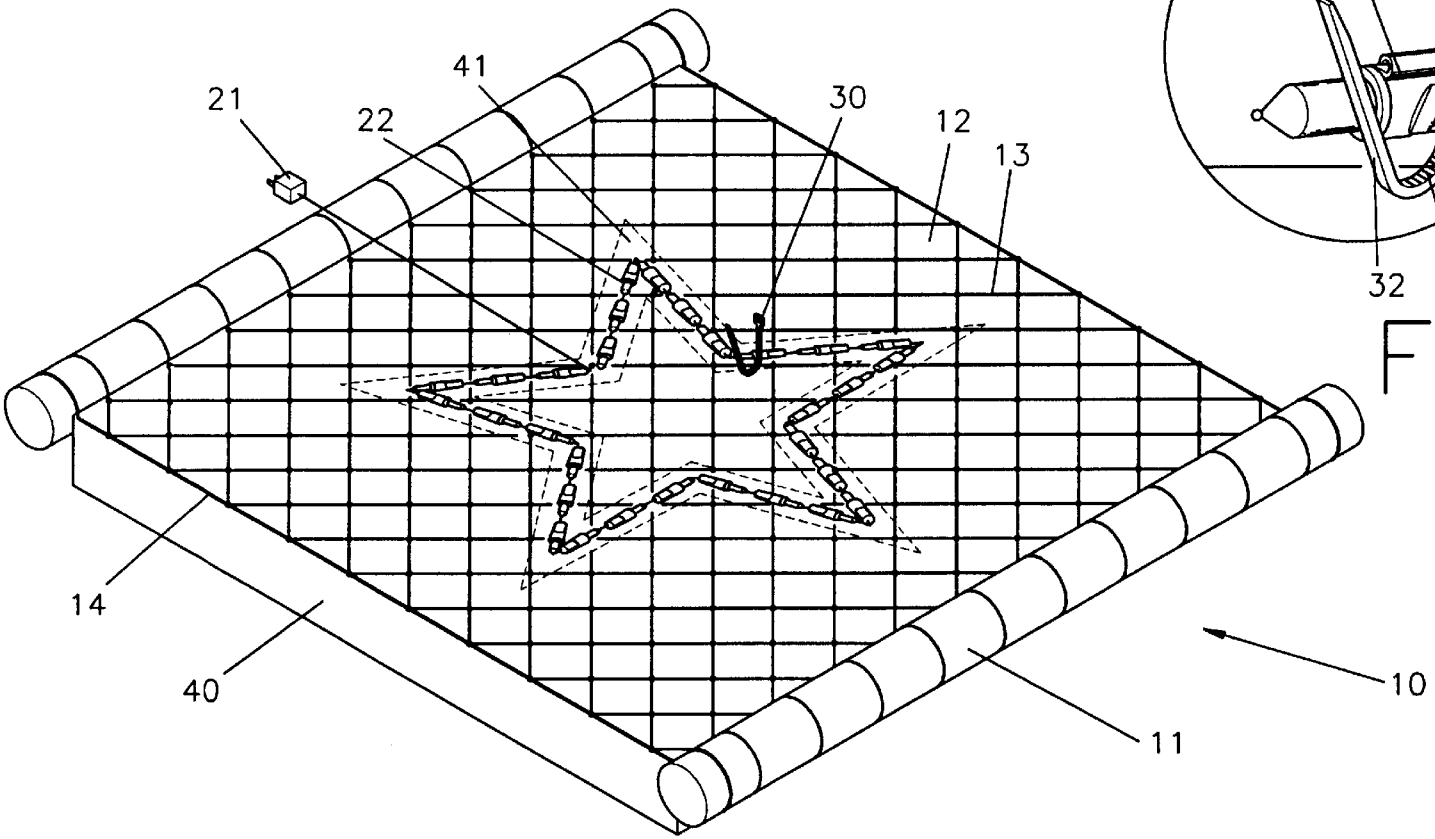
FIG. 2 is a perspective assembly view of FIG. 1.
Figure 3:
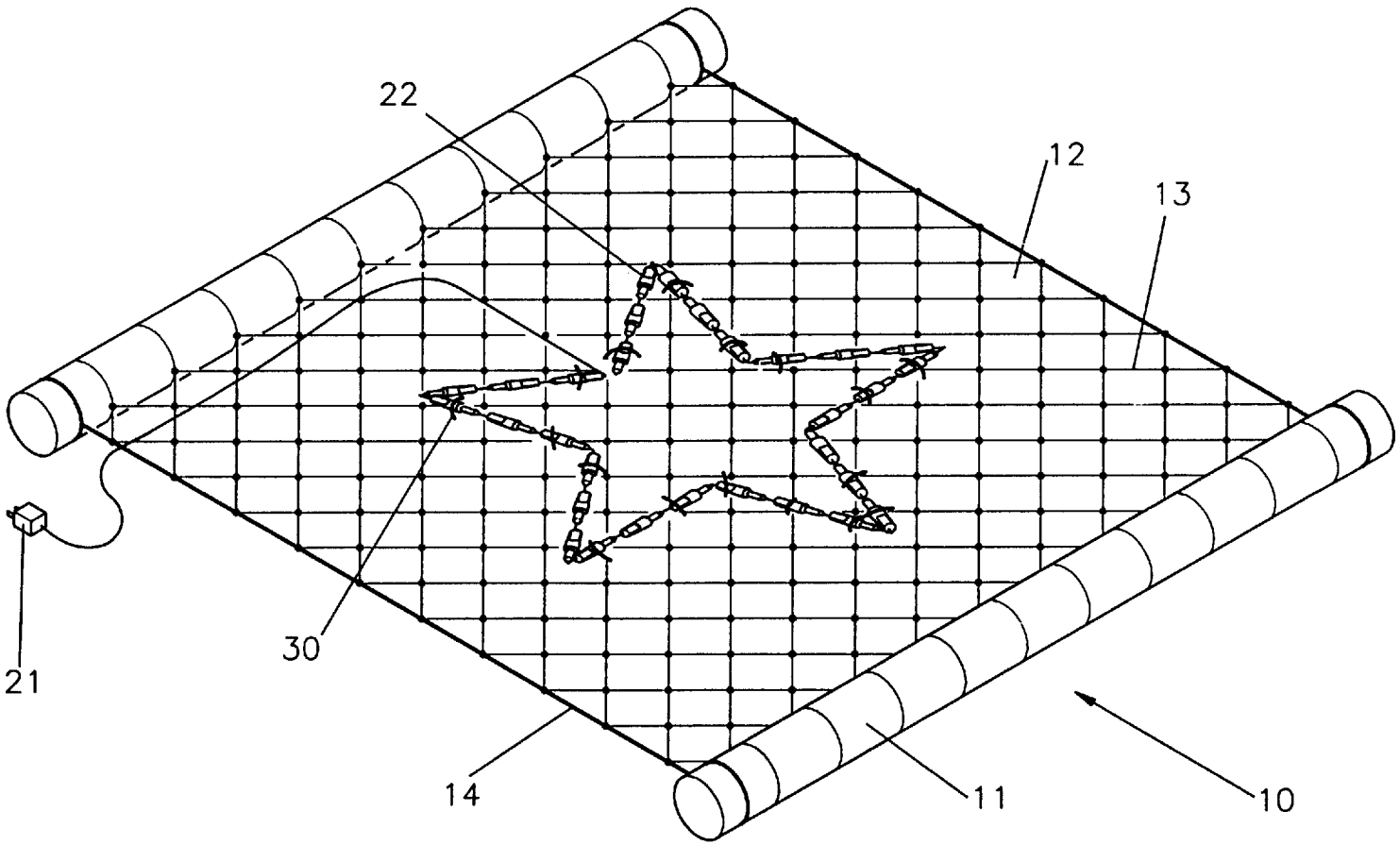
FIG. 3 is a perspective assembly view of a decoration lamp netting without a plate.

Referring to FIGS. 1 to 3, a decoration lamp netting comprises a net 10, a serial decoration lamp assembly 20 disposed on the net 10, the serial decoration lamp assembly 20 having a plurality of decoration lamps 22 and an electric plug 21, a plurality of retainer members 30 retaining the respective decoration lamps 22 on the net 10, and two opposite rods 11 disposed on two laterals of the net 10. The decoration lamp netting is disposed on a plate 40.

The net 10 has a plurality of net strings 13 and two parallel periphery net threads 14 forming a plurality of meshes 12.

The retainer member 30 has a head 31 having a through hole 311, a retaining band 32, and an embossment 321 formed on the retaining band 32. A distal end of the retaining band 32 is inserted in the through hole 311 to retain the respective decoration lamp 22 (as shown in FIG. 2A).

The plate 40 has at least a pattern recess 41. The net 10 is extended on the plate 40. The serial decoration lamp assembly 20 is disposed on the net 10 and arranged along the pattern recess 41. The retainer members 30 retains the respective decoration lamps 22 on the net 10. The rods 11 support the decoration lamp netting.

Figure 4:
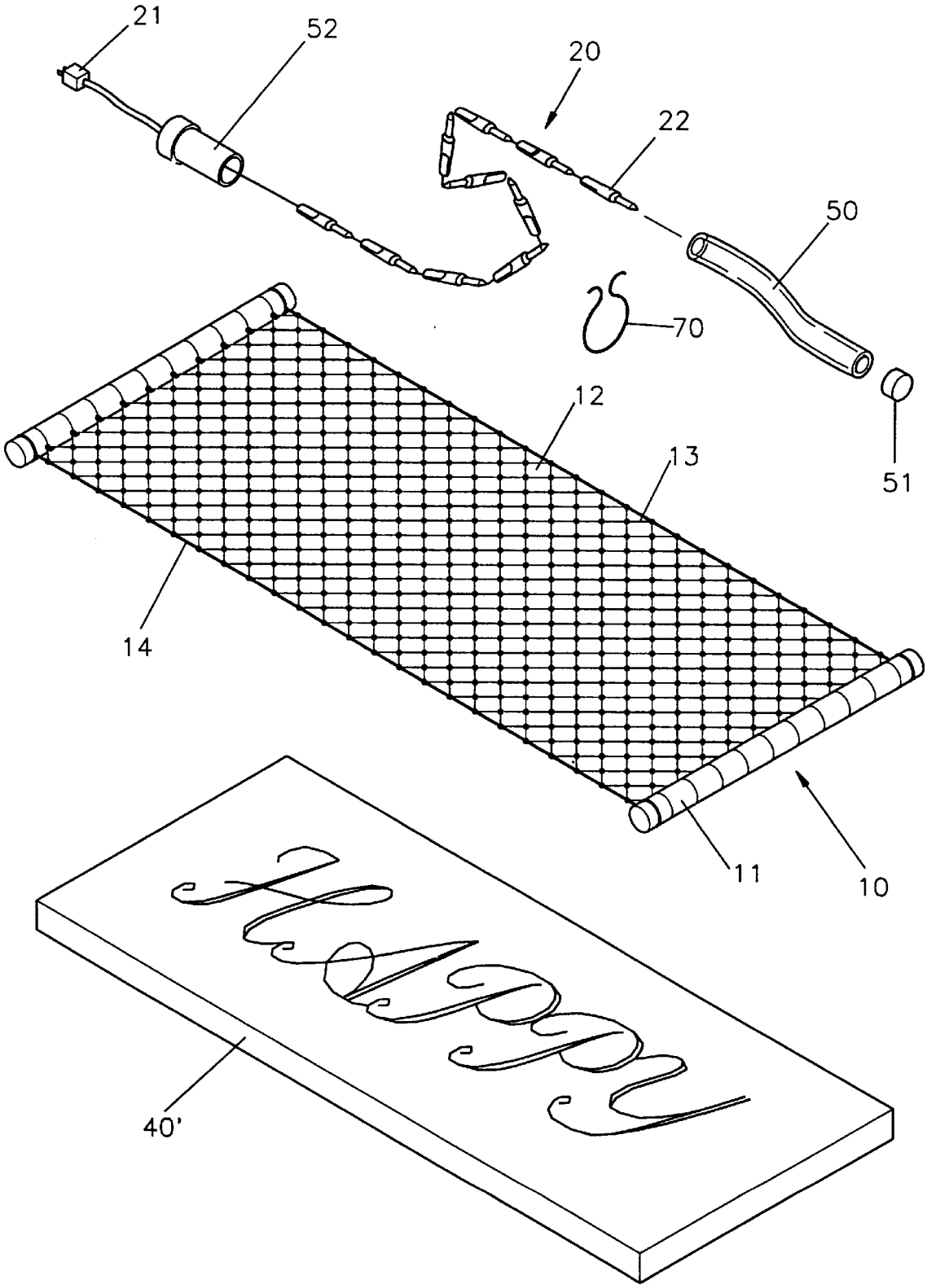
FIG. 4 is a perspective exploded view of a decoration lamp netting and a hose.

Referring to FIG. 4, it is an option to enclose the serial decoration lamp assembly 20 with a transparent hose 50. The serial decoration lamp assembly 20 is inserted in the transparent hose 50. A hollow sleeve 52 receives a first end of the transparent hose 52 and an end plug 51 plugs a second end of the transparent hose 52. Thus the transparent hose 50 is waterproof. A retaining ring 70 can replace the retainer member 30 to retain the transparent hose 52 on the net 10. The second plate 40' can replace the original plate 40.

Figure 5:
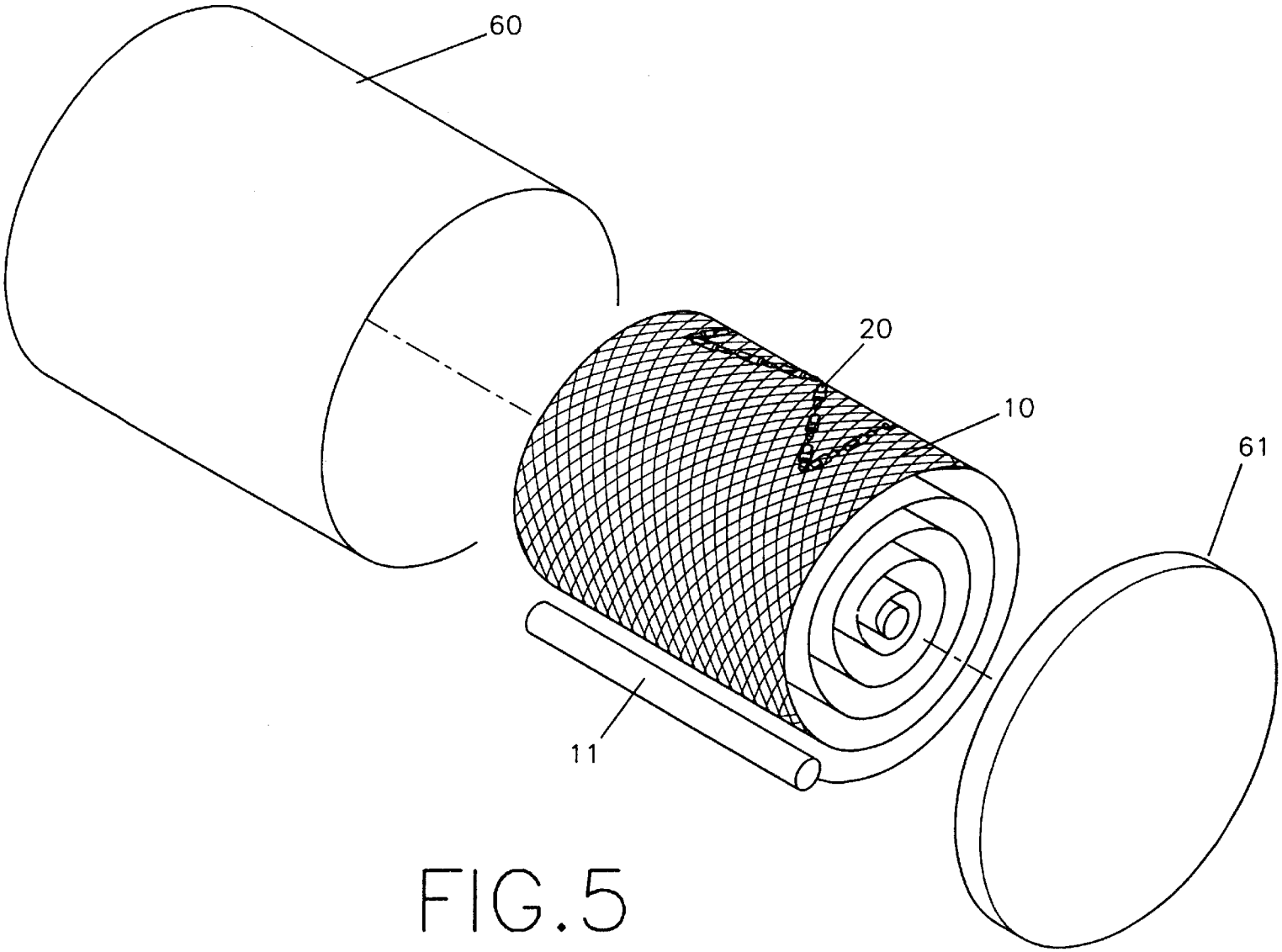
FIG. 5 is a perspective view illustrating a decoration lamp netting is wound and placed in a barrel.

Therefore, the decoration lamp assembly can position the serial decoration lamp assembly 20 on a net 10 and the decoration lamp netting can be wound and placed in a barrel 60. A cover covers the barrel 61 (as shown in FIG. 5).

I claim:

1. A decoration lamp netting comprises:

a net, a serial decoration lamp assembly disposed on the net, the serial decoration lamp assembly having a plurality of decoration lamps and an electric plug, two opposite rods disposed on two laterals of the net, the decoration lamp netting disposed on a plate, the plate having at least a pattern recess, and wherein the net is extended on the plate, the serial decoration lamp assembly is disposed on the net and arranged along the pattern recess, and a plurality of retainer members retain the respective decoration lamps on the net.

2. A decoration lamp netting as claimed in claim 1, wherein the net has a plurality of net strings and two parallel periphery net threads.

3. A decoration lamp netting as claimed in claim 1, wherein each of the retainer members has a head having a through hole and a retaining band.

4. A decoration lamp netting as claimed in claim 1, wherein the serial decoration lamp assembly is inserted in a transparent hose, a hollow sleeve receives a first end of the transparent hose and an end plug plugs a second end of the transparent hose.

* * * * *